US011585137B2

(12) United States Patent
Zindler et al.

(10) Patent No.: US 11,585,137 B2
(45) Date of Patent: Feb. 21, 2023

(54) MODIFIED DOOR OPERATION FOR A MOTORIZED VEHICLE

(71) Applicant: The Braun Corporation, Winamac, IN (US)

(72) Inventors: Michael T. Zindler, Kalamazoo, MI (US); Adam D. Wojdyla, Winamac, IN (US); Robert E. Bettcher, III, Winamac, IN (US); James Stoner, Star City, IN (US); Jon Beck, Winamac, IN (US)

(73) Assignee: The Braun Corporation, Winamac, IN (US)

( * ) Notice: Subject to any disclaimer, the term of this patent is extended or adjusted under 35 U.S.C. 154(b) by 232 days.

(21) Appl. No.: 16/918,135

(22) Filed: Jul. 1, 2020

(65) Prior Publication Data

US 2021/0002937 A1 Jan. 7, 2021

Related U.S. Application Data

(60) Provisional application No. 62/869,632, filed on Jul. 2, 2019.

(51) Int. Cl.
*E05D 15/30* (2006.01)
*E05D 15/58* (2006.01)
(Continued)

(52) U.S. Cl.
CPC ..... *E05D 15/30* (2013.01); *A61G 3/061* (2013.01); *E05D 15/58* (2013.01); *E05F 15/60* (2015.01);
(Continued)

(58) Field of Classification Search
CPC .... E05D 15/30; E05D 15/58; E05D 2015/586
See application file for complete search history.

(56) References Cited

U.S. PATENT DOCUMENTS 2,474,468 A * 6/1949 Cornelius ..... E05D 15/30 49/248
4,544,198 A 10/1985 Ochiai et al.
(Continued)

FOREIGN PATENT DOCUMENTS

DE 19647128 A1 * 5/1998 ..... B60J 5/047
EP 2644817 A2 * 10/2013 ..... E05D 15/30
(Continued)

OTHER PUBLICATIONS

International Search Report & Written Opinion of PCT/US2020/040426, Korean Intellectual Property Office, dated Oct. 20, 2020, 12 pages.

*Primary Examiner* — Marcus Menezes
(74) *Attorney, Agent, or Firm* — Daniel Tallitsch

(57) ABSTRACT

A door opening assembly is provided for moving a door of a vehicle between an open position and a closed position. The assembly includes a frame member coupled to the vehicle, a link is coupled to the frame member, and a link arm pivotally coupled to the link. A pivot arm is pivotally coupled to the frame member and a pivot bracket is pivotally coupled to the door and the pivot arm. The pivot bracket includes a slot such that a pin on the link arm slides therethrough. The assembly includes a gear rack and a gear operably coupled to the gear rack. The gear is driven by a motor as the door moves between its open and closed positions. The assembly further includes a guide track coupled to the vehicle and a roller rotatably driven along the guide track as the door moves between its open and closed positions.

20 Claims, 11 Drawing Sheets

(51) Int. Cl.
*E05F 15/60* (2015.01)
*A61G 3/06* (2006.01)
*E05F 15/73* (2015.01)

(52) U.S. Cl.
CPC ..... *E05F 15/73* (2015.01); *E05D 2015/586* (2013.01); *E05Y 2900/531* (2013.01)

(56) References Cited

U.S. PATENT DOCUMENTS 4,862,640 A 9/1989 Boyko et al.
4,869,544 A 9/1989 Anwyll et al.
6,036,257 A 3/2000 Manuel
6,079,767 A * 6/2000 Faubert ..... E05F 15/646 296/155
6,178,697 B1 1/2001 Goodrich et al.
6,430,875 B1 * 8/2002 Clark ..... F16D 43/02 49/360
6,494,519 B2 12/2002 Sturgin et al.
6,644,717 B2 11/2003 Lorentz
6,932,417 B2 8/2005 Barczynski et al.
7,159,929 B2 1/2007 Fukushima et al.
7,717,493 B2 5/2010 Plavetich
7,810,282 B2 10/2010 Oxley
8,567,126 B2 10/2013 Hozumi et al.
8,998,558 B2 4/2015 Kitchin et al.
9,475,368 B2 10/2016 Choi
9,896,871 B2 2/2018 Ungetheim et al.
2005/0082871 A1 * 4/2005 Anders ..... E05F 15/638 296/155
2006/0267375 A1 * 11/2006 Enomoto ..... E05F 15/646 296/155
2009/0007258 A1 3/2009 Elliott et al.
2009/0072583 A1 * 3/2009 Elliott ..... B60J 5/0479 296/24.3
2009/0230721 A1 * 9/2009 Rusnak ..... E05D 15/1047 296/146.5
2009/0230722 A1 9/2009 Krajenke et al.
2010/0295337 A1 * 11/2010 Elliott ..... E05D 15/101 296/202
2011/0010998 A1 * 1/2011 Elliott ..... E05D 15/101 49/260
2012/0167468 A1 * 7/2012 Hozumi ..... E05D 15/58 49/209
2014/0075843 A1 3/2014 Maruyama et al.
2016/0023654 A1 1/2016 Yamashita
2016/0114659 A1 * 4/2016 Maruyama ..... E06B 3/509 49/164
2016/0236546 A1 * 8/2016 Wojdyla ..... E05D 3/147
2016/0237733 A1 * 8/2016 Henseleit ..... E05D 3/147
2021/0277695 A1 * 9/2021 Bakker ..... E05F 15/646

FOREIGN PATENT DOCUMENTS

EP 2826648 A1 1/2015
FR 2816978 A1 * 5/2002 ..... B60J 5/047
GB 2408025 B2 4/2007

* cited by examiner

MODIFIED DOOR OPERATION FOR A MOTORIZED VEHICLE

RELATED APPLICATIONS

This application claims the benefit of U.S. Provisional Patent Application Ser. No. 62/869,632, filed Jul. 2, 2019 and entitled "MODIFIED DOOR OPERATION FOR A MOTORIZED VEHICLE," the disclosure of which is hereby incorporated by reference in its entirety.

FIELD OF THE DISCLOSURE

The present disclosure relates to a motorized vehicle for transporting one or more passengers, and more particularly to a motorized vehicle which is retrofitted for transporting one or more physically limited passengers seated in a wheelchair.

BACKGROUND

Automobile manufacturers do not currently mass-produce passenger vehicles specifically designed to transport passengers having physical limitations, either as a driver or as a non-driving passenger. Consequently, mass-produced passenger vehicles are modified, or retrofitted, by a number of aftermarket companies dedicated to supplying vehicles to physically limited passengers. Such vehicles can be modified by removing certain parts or structures within a vehicle and replacing those parts with parts specifically designed to accommodate the physically limited passenger. For example in one configuration, a van may be retrofitted with a ramp to enable a physically limited individual using a wheelchair to enter the vehicle without the assistance of another individual.

Other known level change devices for retrofitting a vehicle, such as a van, include wheelchair lifts, lift platforms, and lowered floor surfaces. In some instances, a door of an original equipment manufacturer (OEM) van is enlarged or otherwise modified to permit entry of the physically limited individual through what is known as the assisted entrance. Once inside the vehicle, individuals who use the assisted entrance are often located in a rear passenger compartment of the vehicle adjacent to or behind the assisted entrance.

Many motorized vehicles modified to include a ramp or lift for transporting physically limited passengers are passenger vans or buses. Minivans, or passenger vans, are often referred to as multi-purpose vehicles (HPVs), people movers, or multi-utility vehicles. At least in the United States, minivans are classified as light trucks or MPVs. In many instances, these vans have rear access doors on each side thereof that, when opened, define a door opening that can provide easy ingress and egress of a wheelchair.

Crossover and sport-utility vehicles have become popular due to their style and driving performance. Sport-utility vehicles are built off a light-truck chassis similar to passenger vans, whereas crossover or crossover utility vehicles are built from a passenger car chassis. Due to their build, crossover vehicles are often more fuel efficient than heavier, sport-utility vehicles and include other advantages over minivans and sport-utility vehicles.

SUMMARY

In a first embodiment of the present disclosure, a door opening assembly is provided for moving a vehicle door of a motorized vehicle between an open position and a closed position. The assembly includes a frame member configured to be coupled to a body of the vehicle; a link operably coupled to the frame member; a link arm comprising a pin, the link arm pivotally coupled to the link; a pivot arm pivotally coupled to the frame member; a pivot bracket pivotally coupled to the door and the pivot arm, the pivot bracket further defining a slot having a first end and a second end; a gear rack comprising a plurality of teeth, the gear rack including a first end and a second end; a gear operably coupled to the gear rack, the gear operably driven between the first and second ends of the gear rack as the door moves between its open and closed positions; a guide track configured to be coupled to the body of the vehicle; and a plurality of rollers rotatably driven along the guide track as the door moves between its open and closed positions; wherein, as the door moves between its open and closed positions, the pin moves within the slot between the first end and the second end.

In a first example of this embodiment, the pivot arm is pivotally coupled to the frame member about a first pivot axis; and the pivot bracket is pivotally coupled to the pivot arm about a second pivot axis, wherein the first pivot axis is parallel to but spaced from the second pivot axis. In a second example, the pivot bracket is pivotally coupled to a mounting bracket about a third pivot axis, the third pivot axis being parallel but offset from the first and second pivot axes. In a third example, the gear rack comprises a substantially S-shaped curvature.

In a fourth example, the gear rack comprises a length defined between its first end and its second end, the gear rack comprising a first arc portion, a second arc portion, and a substantially linear portion. In a fifth example, the gear rack comprises a first vertex, a second vertex, and an inflection point located therebetween; wherein the first arc portion is defined between the first end of the gear rack and the inflection point; the second arc portion is defined between the inflection point and the substantially linear portion; the substantially linear portion defined between the second end of the gear rack and the second arc portion.

In a sixth example of this embodiment, the guide track comprises a shape substantially the same as the gear rack. In a seventh example, the plurality of rollers comprises a first roller and a pair of second rollers, the first roller having a larger diameter than each of the pair of second rollers. In an eighth example, the first roller is rotatable about a first rotation axis; a first of the pair of second rollers is rotatable about a second rotation axis; a second of the pair of second rollers is rotatable about a third rotation axis; the first rotation axis being oriented substantially perpendicular to the second and third rotation axes.

In another example of this embodiment, in the closed position, the pin is located at the first end of the slot and the gear is located at the first end of the gear rack; in the open position, the pin is located at the second end of the slot and the gear is located at the second end of the gear rack. In yet another example, during movement of the door from its closed position to its open position, the gear moves from the first end of the gear rack to an intermediate position; wherein, in the closed position, the door is positioned along a door frame axis; wherein, in the intermediate position, the door is positioned at an angle relative to the door frame axis; wherein, in the open position, the door is positioned substantially parallel to but offset from the door frame axis. In a further example, a first distance defined between the first end and the intermediate position of the gear rack is shorter than a second distance defined between the intermediate position and the second end of the gear rack.

In another embodiment of the present disclosure, a door opening assembly is provided for moving a vehicle door of a motorized vehicle between an open position and a closed position. The assembly includes a first assembly comprising a frame member configured to be coupled to a body of the vehicle; a link operably coupled to the frame member; a link arm comprising a pin, the link arm pivotally coupled to the link; a pivot arm pivotally coupled to the frame member; and a pivot bracket pivotally coupled to the door and the pivot arm, the pivot bracket further defining a slot having a first end and a second end; wherein, as the door moves between its open and closed positions, the pin moves within the slot between the first end and the second end; a second assembly comprising a gear rack comprising a plurality of teeth, the gear rack including a first end and a second end; a gear operably coupled to the gear rack, the gear operably driven by a motor between the first and second ends of the gear rack as the door moves between its open and closed positions; a guide track configured to be coupled to the body of the vehicle; and a plurality of rollers rotatably driven along the guide track as the door moves between its open and closed positions; and a control system for operably controlling the motor, the control system including a controller; wherein, the controller is configured to receive a communication from a user control to operably drive the motor to move the door from its open and closed positions.

In one example of this embodiment, a second motor operably controls pivotal movement of the pivot arm or pivot bracket, the second motor operably driven by the controller. In a second example, a sensor is in communication with the controller, the sensor configured to detect a location of the pin relative to the first and second ends of the slot. In a third example, a sensor is in communication with the controller, the sensor configured to detect a location of the gear relative to the first and second ends of the gear rack. In a fourth example, a sensor is in communication with the controller, the sensor being configured to detect a location of at least one of the plurality of rollers relative to the guide track.

In a fifth example, a ramp assembly is operably coupled to the body of the vehicle; a sensor in communication with the controller, the sensor configured to detect a position of the ramp assembly relative to the body of the vehicle. In a sixth example, the controller operably disables the motor when the sensor communicates to the controller that the ramp assembly is in a deployed position.

In a further embodiment of the present disclosure, a method is provided of controlling movement of a vehicle door from a closed position to an open position such that the vehicle door is operably coupled to a body of a motorized vehicle. The method includes providing the vehicle door with a door opening assembly comprising a frame member coupled to the body of the vehicle, a link, a link arm including a pin, a pivot arm, a pivot bracket having a slot, a gear rack, a gear, a motor, a guide track, a plurality of rollers, and a controller; in the closed position, positioning the pin at a first end of the slot, the gear at a first end of the gear rack, and the plurality of rollers at a first end of the guide track; releasing a latch of the door from the body of the motorized vehicle; driving the motor by the controller to pivot the door from the closed position to a partially open position, where in the partially open position the gear is at an intermediate position and the pin is located between the first end and a second end of the slot; and driving the motor by the controller from the partially open position to the open position, where in the open position the gear is at a second end of the gear rack, the pin is at the second end of the slot, and the plurality of rollers are located at a second end of the guide track.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

Figure 1:
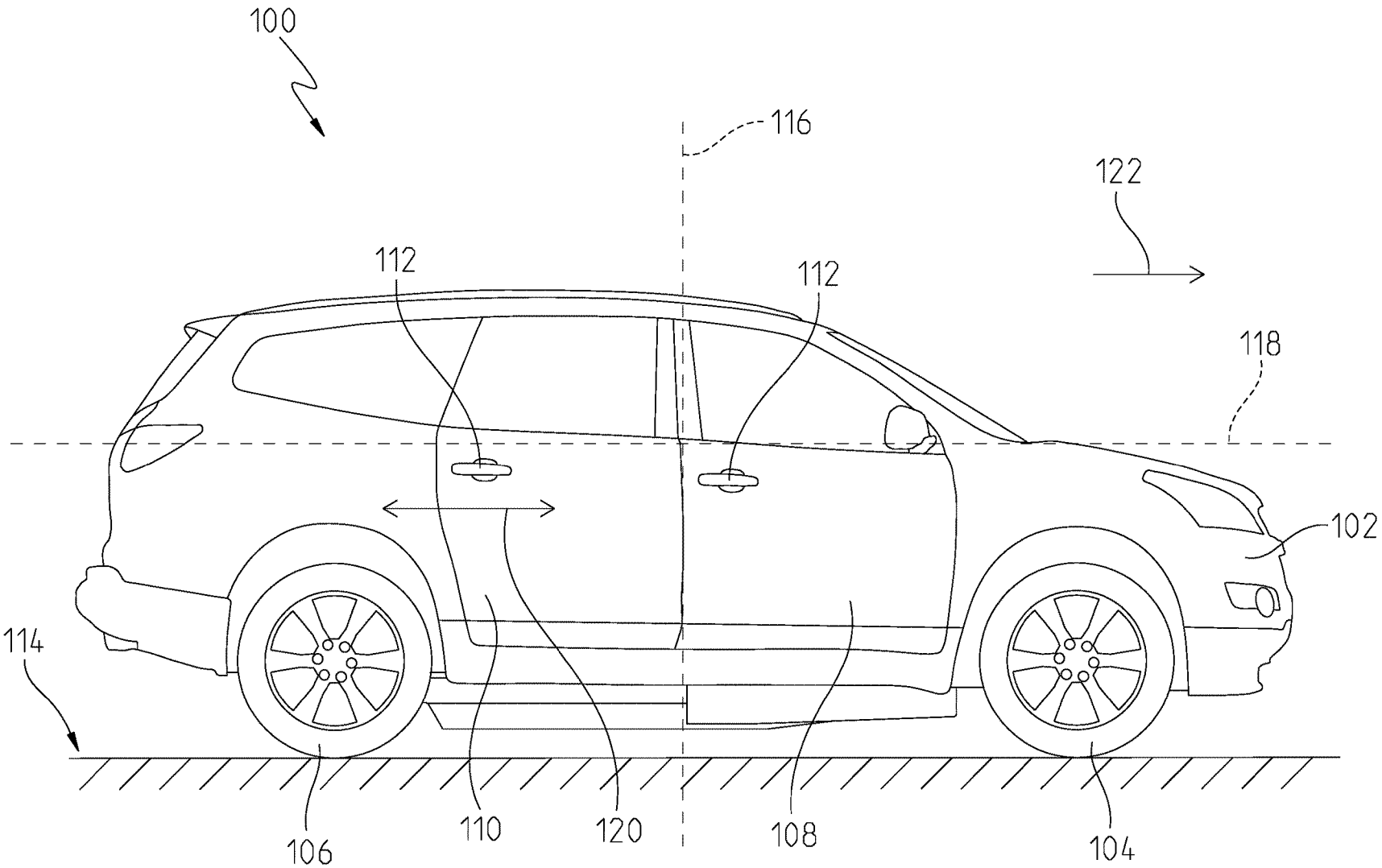
FIG. 1 illustrates a side view of a motorized vehicle.

FIG. 1 illustrates an embodiment of a sport-utility vehicle (SUV) or crossover vehicle (CV) 100 available from any number of United States and foreign manufacturers. In one example, the vehicle is a Chevrolet® Traverse. In the illustrated embodiment, the vehicle 100 may a unibody construction. Other SUVs or crossover vehicles contemplated within this disclosure may include a frame on body construction. Consequently, the use of SUV herein includes all types and kinds of sport utility vehicles constructed with a body on frame construction, a unibody construction, or other constructions.

As shown in FIG. 1, the vehicle 100 may include a vehicle body or chassis 102 operatively coupled to front wheels 104 and rear wheels 106 which support the vehicle 100 as it traverses the ground 114. The vehicle 100 may include a unibody construction designed off of a truck chassis. The vehicle body 102 may also define a body or vehicle axis 118 through the center of the vehicle 100. The body axis 118 may be defined along the length of the vehicle 100. The vehicle may be designed to have a gross vehicle weight of at least 6000 pounds. In another aspect, the rating may be at least 8000 pounds but less than approximately 10000 pounds. In a further aspect, the rating may be between approximately 6000 and 10000 pounds.

As shown, a first or front passenger side door 108 is located between the front wheels 104 and rear wheels 106 and provides access to a passenger for sitting in a front seat of the vehicle 100 adjacent to the driver. In this position, the passenger has a clearer forward view of the road when compared to sitting in a middle row or back row of seats of the vehicle 100. Moreover, when seated, the passenger may be facing in a forward direction of travel 122.

In its conventional arrangement, the vehicle 100 of FIG. 1 may include a second passenger side door 110 coupled to the unibody frame via a conventional hinge-style door coupling mechanism (not shown). One or more hinges (not shown) may be used for coupling the conventional door 110 to the body or chassis 102. Thus, to open the door 110, a door latch 112 may be pulled or otherwise manipulated in a known way to unlatch the door 110 and allow it to be opened in a pivot-like manner. In particular, the conventional hinges may be aligned along a pivot axis 116 as shown in FIG. 1 such that the door 110 may pivot between its open and closed position.

These conventional hinge-style doors are inconvenient, however, when the passenger entering or exiting the vehicle is physically limited and/or in a wheelchair. The door opening is often not wide enough, or if it is, the door does not open wide enough to accommodate a ramp for a wheelchair. For this reason, many vehicles that can accommodate a wheelchair ramp are built on a larger vehicle chassis such as a bus or van. Vehicles such as sport-utility vehicles and the like are often unable to accommodate a ramp or wheelchair from a side door. Thus, there is a need for a modified vehicle, and in particular a modified door, to accommodate a wheelchair ramp and physically limited passenger. To do so, the rear door 110 of the vehicle 100 may be modified according to the principles and teachings of the present disclosure such that the door 110 moves in a generally forward and rearward direction indicated by arrow 120.

Figure 2:
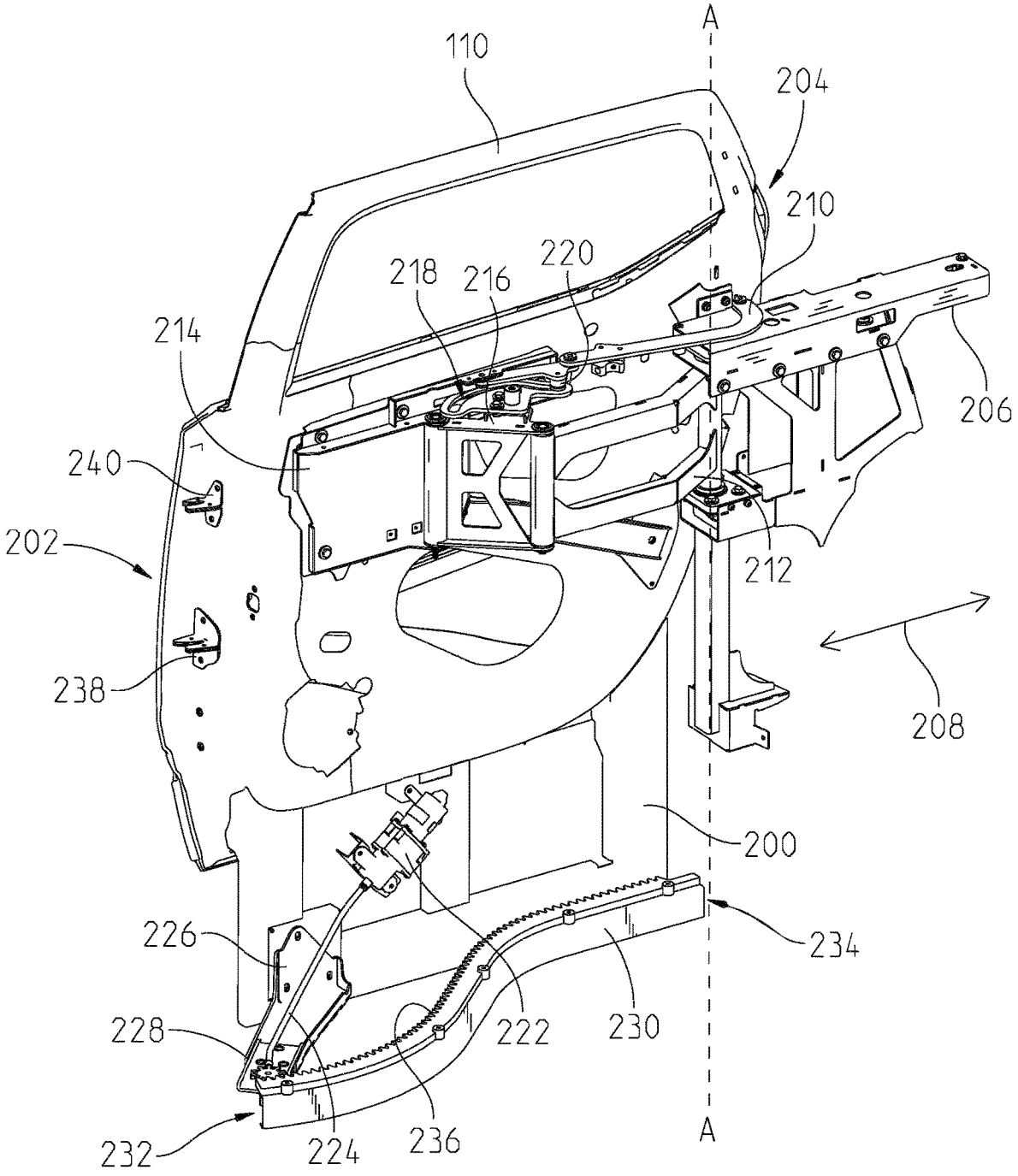
FIG. 2 illustrates an interior perspective view of a modified hinge-style door.

Referring to FIG. 2, a modified rear passenger door 110 is shown. Here, an inner surface 200 of the door 110 is shown having a front side 202 and a rear side 204. The inner surface 200 in FIG. 2 may be an additional panel or frame structure coupled to the conventional OEM-style rear passenger door 110. The additional panel or frame structure 200 may be added due to some modifications made to the vehicle floor to accommodate a ramp assembly 300 such as the one shown in FIG. 3. For example, in some modifications, the vehicle floor may be lowered from its conventional height in order to incorporate a cavity or storage space to accommodate the ramp assembly 300 when it is in a stowed position. Due to the lowered floor, the additional door panel or frame structure 200 may be necessary to fully enclose the interior of the vehicle.

The front side 202 may include a first latch 238 and a second latch 240. The first latch 238 may engage a first striker (not shown) on the door frame (not shown) of the vehicle 100 in a closed position, and the second latch 240 may engage a second striker (not shown) in the closed position. The first and second strikers may take many forms, but for sake of this disclosure, each striker is configured to engage the first and second latches on the door to couple the door to the frame in the closed position. It is noted that the conventional door hinges are removed from the door 110 during the modification process and replaced by the first latch 238 and second latch 240. Moreover, the strikers may be mounted to the door frame in any conventional manner.

While the present disclosure describes the use of latches in the form of the first latch 238 and second latch 240, other embodiments may utilize a hook or guide in place of either or both latches. The hook or guide may further assist with guiding the door 110 along its intended motion or profile when moving into a closed position. Moreover, these may provide a pivot point to complete the door closing process. Other similar coupling devices may be used besides a latch, hook, or guide when coupling the door to the vehicle or door frame in the closed position.

The door 110 may be further modified by providing a frame member 206 that may include a base 406 (FIG. 4) coupled to the vehicle 100 (e.g., the vehicle floor). The frame member 206 may define a pivot axis A-A about which the door opening assembly may pivot. It is noted that the pivot axis A-A is spaced rearwardly of the conventional pivot axis 116 about which the conventional rear door pivots about the door frame (not shown).

The door opening assembly may further include a link 210 coupled to the frame member 206. The link 210 includes a first end coupled to the frame member 206 and a second end to a link arm 418 (see FIG. 4). The link arm 418 may be pivotally coupled to the link 210 via a pivot connection 416. Similarly, the link 210 may be pivotally coupled to the frame member 206 via a second pivot connection 414 (see FIG. 4).

Figure 4:
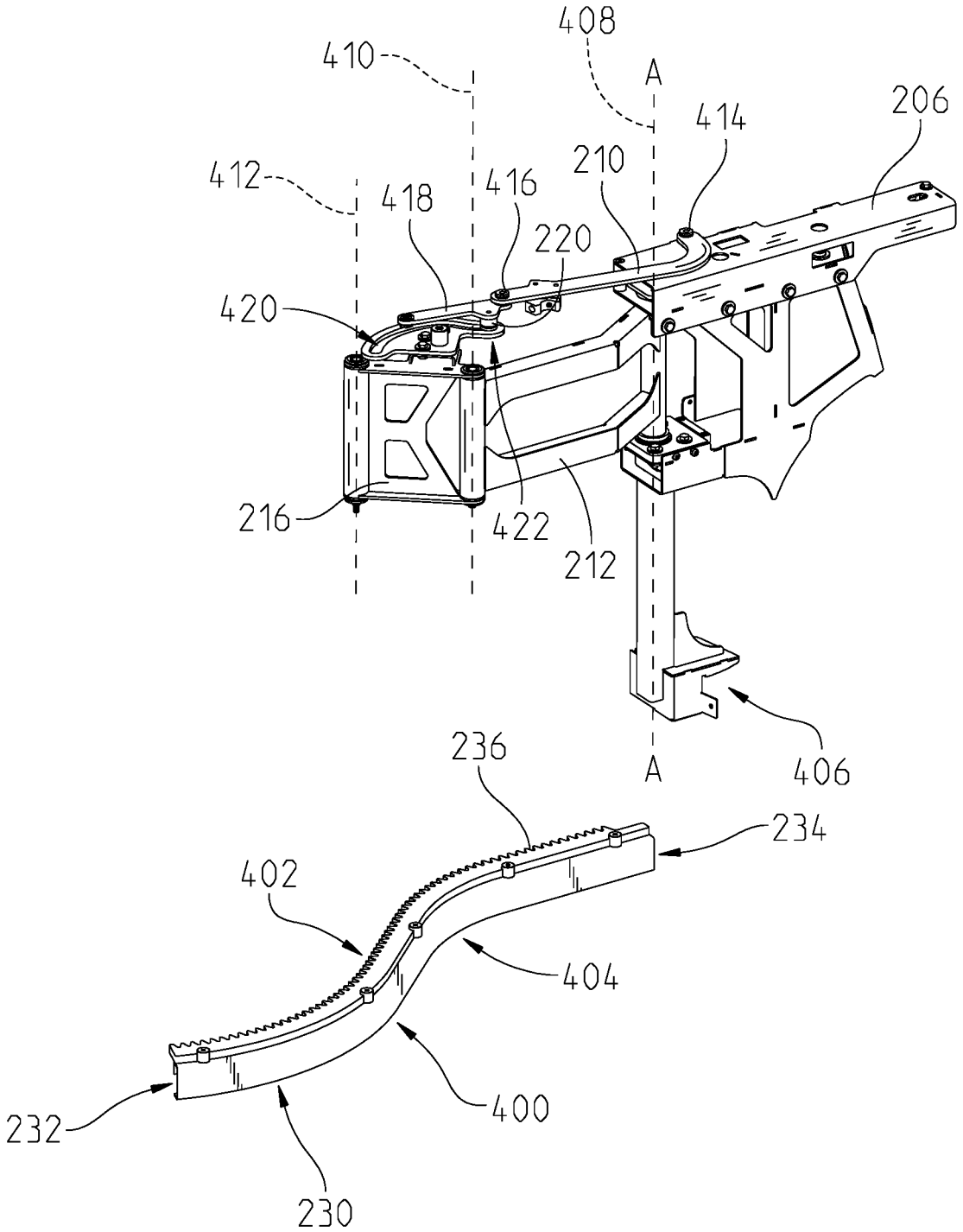
FIG. 4 is a partial perspective and exploded view of a door opening assembly for the modified hinge-style door of FIG. 2.

The frame member 206 is designed to be coupled to a pivot arm 212 about the pivot axis A-A. The pivot arm 212 may include an upper arm and a lower arm spaced vertically from one another. Each of the upper arm and lower arm is coupled to a vertical portion that is coupled to the frame member 206 and aligned along the pivot axis A-A. As shown in FIG. 4, the pivot axis A-A may also be referred to as a first pivot axis 408. A second vertical portion of the pivot arm 212 is coupled to the opposite ends of the upper and lower arms such that a pivot bracket 216 may be coupled thereto. The pivot bracket 216 may pivot relative to the pivot arm 212 about a second pivot axis 410 (see FIG. 4). The pivot bracket 216 may further be coupled to the door 110 via a mounting bracket 214. The mounting bracket 214 may be a plate or the like that is coupled to the inner surface 200 of the door 110. The pivot bracket 216 may be pivotally coupled to the mounting bracket 214 along a third pivot axis 412.

The pivot bracket 216 may also define a slot 218 in a portion thereof. The slot 218 is arcuate in shape and is configured to receive a pin 220 that is coupled to or integrally formed with the link arm 418. The pin 220 is configured to travel through the slot 218 as the door 110 moves between its open and closed positions. As shown in FIG. 4, the slot 218 may include a first end 420 and a second end 422. As will be further described below, the pin 220 may be disposed at the first end 420 of the slot 218 in the closed position and at the second end 422 of the slot 218 in the open position. As the pin 220 slides or moves through the slot 218, the door 110 may be move in a generally forward and rearward direction 208 between the open and closed positions.

A second portion of the door opening assembly is also shown in FIG. 2 with a gear 228 and gear rack 230. The gear rack 230 may be coupled to a guide track (not shown) which is coupled to the vehicle such as the floor or other portion thereof. The gear rack 230 may further include a plurality of teeth 236 aligned along its length from a first end 232 to a second end 234. Likewise, the gear 228 may include teeth for engaging with the teeth 236 on the gear rack 230.

The gear 228 may be driven by a motor 222 or actuator. The motor 222 may be an electrical, mechanical, hydraulic, or a combination thereof. Alternatively, the motor 222 may be another type of conventional motor for operably driving the gear 228. The motor 222 may include an output coupled to a cable 224 or link for operably rotating the gear 228 and driving it to move along the gear rack 230 between the first and second ends. The motor 222 may be coupled to the inner surface 200 of the door 110, and the cable 224 and gear 228 may be coupled to a bracket 226 as shown in FIG. 2. For purposes of this disclosure, the combination of the motor 222, cable 224, bracket 226, gear 228 and gear rack 230 forms a lower linkage of the door opening assembly.

Figure 9:
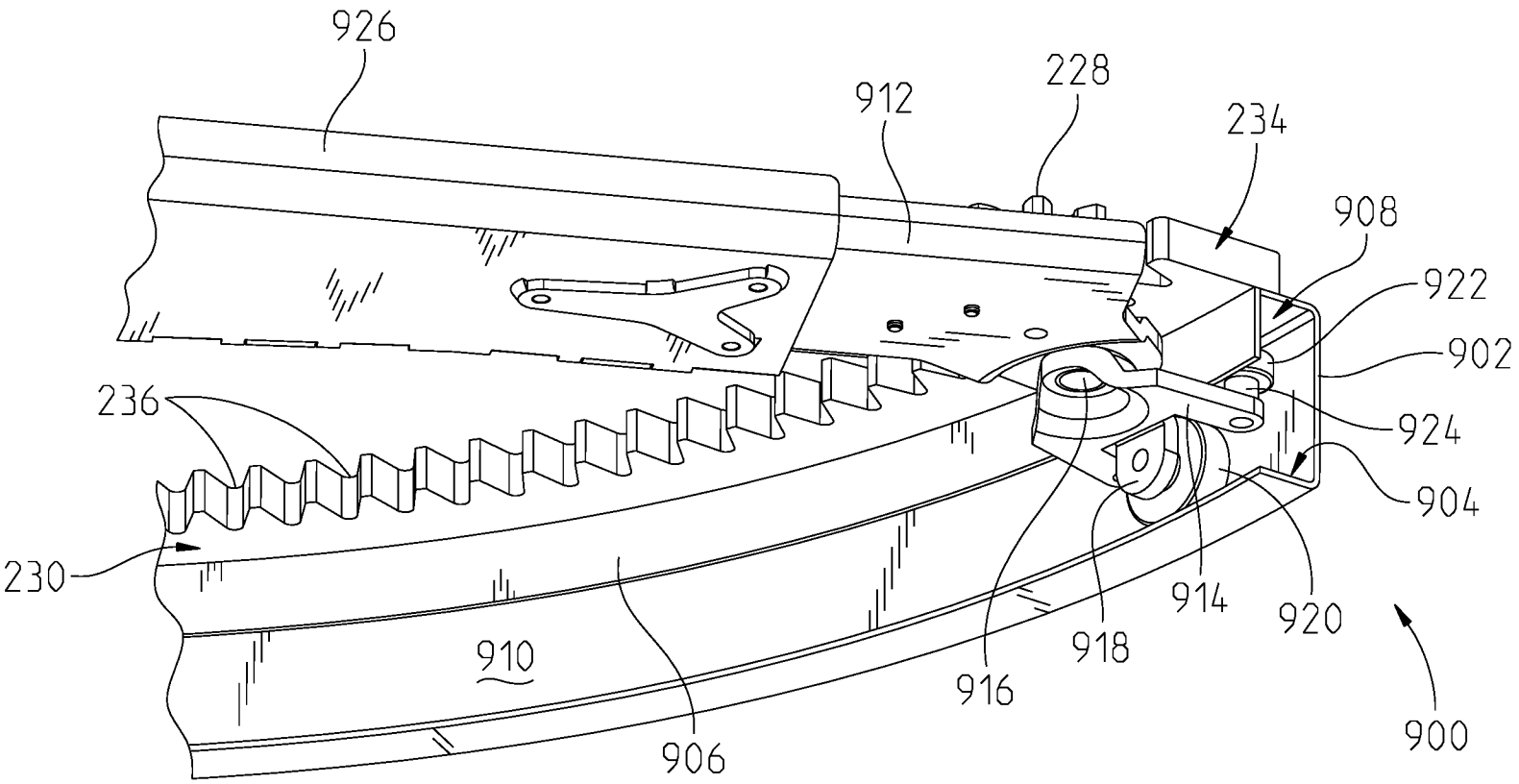
FIG. 9 illustrates a partial perspective view of a guide track assembly.
Figure 10:
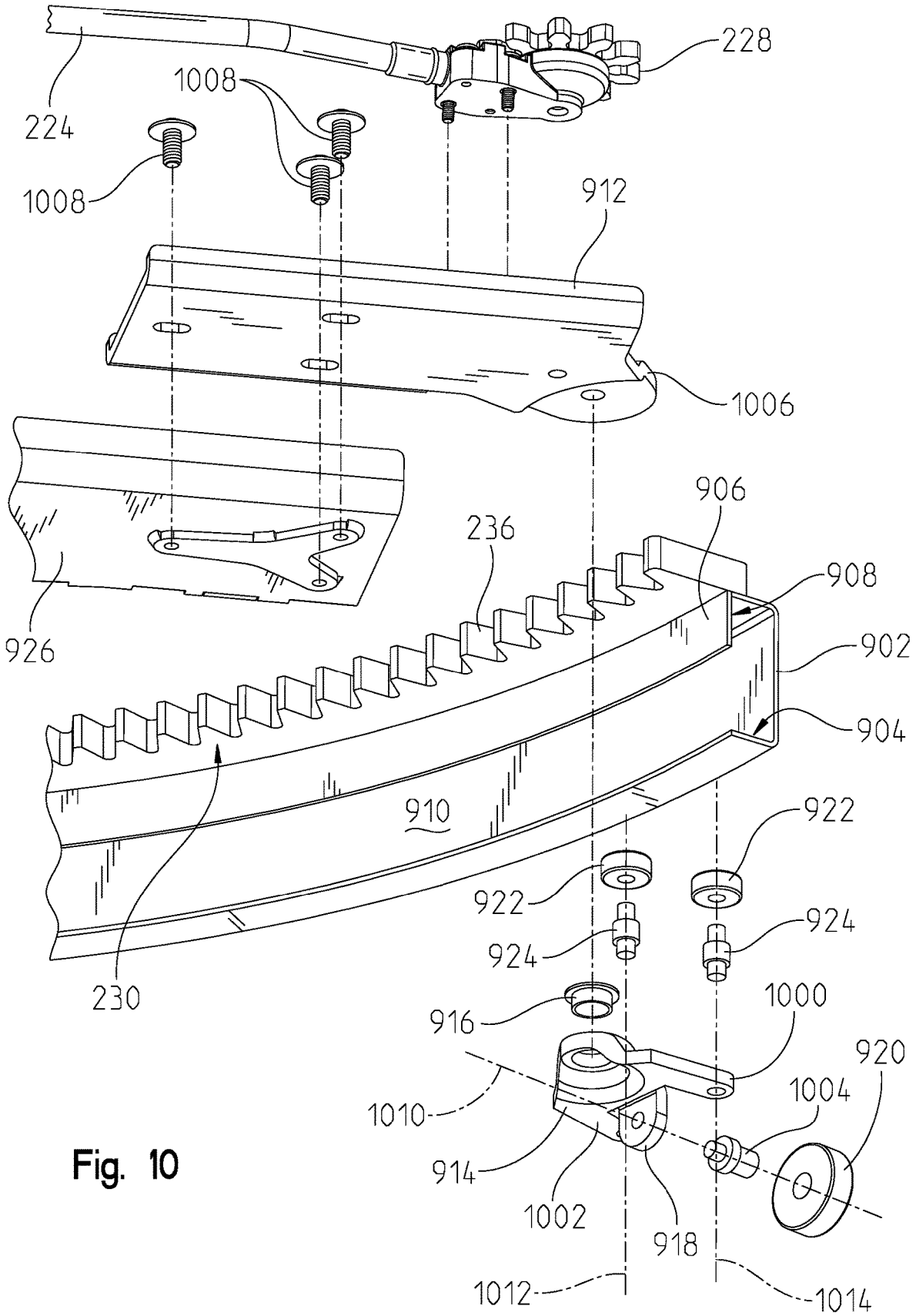
FIG. 10 illustrates an exploded view of the guide track assembly of FIG. 9.

Referring to FIGS. 9 and 10, the gear 228 may be further coupled to a guide track and roller assembly 900. The guide track and roller assembly 900 may include a guide track 902 as shown. The guide track 902 may be coupled to the vehicle body or chassis 102 and comprises a circuitous path that closes follows the same path or shape as the gear rack 230. The path or shape of the gear rack 230 is described further below.

As shown in FIG. 9, the guide track 902 may be formed with a lip 906 and a plurality of surfaces. For example, the guide track 902 may include a bottom or lower surface 904 and a first side surface 908. The lip 906 may form a second side surface 910. The guide track 902 is substantially open except for the portion which is covered by the lip 906 which is disposed downwardly from a top surface of the guide track 902.

The guide track and roller assembly 900 may also include a plurality of rollers that slidingly engage and move about the guide track 902. The plurality of rollers may include a first roller 920 and a pair of second rollers 922. The first roller 920 may include a larger diameter than the pair of second rollers. Moreover, the first roller 920 may rotate about a first rotation axis 1010 (FIG. 10), whereas the pair of second rollers 922 may rotate about a second rotation axis 1012 and a third rotation axis 1014, respectively. The second and third rotation axes may be parallel but offset from one another. Further, the first rotation axis 1010 may be oriented substantially perpendicular to the second and third rotation axes 1012, 1014.

The guide track and roller assembly 900 may further include an arm assembly 912. The arm assembly 912 may include a support member 926 coupled thereto via one or more fasteners 1008. The cable 924 and gear 928 may also be coupled to the arm assembly 912, and in particular to an arm portion 1006 as shown in FIG. 10.

The plurality of rollers may be operably coupled to the arm assembly 912 via a bracket 914. The bracket 914 may include a first finger 1000 spaced from a second finger 1002, as shown in FIG. 10. Each of the pair of second rollers 922 may be rotatably coupled to the respective first and second fingers via a pin 924. The second and third rotation axes may be defined through the respective pins 924. The bracket 914 may be operably coupled to the arm portion 1006 via a connection bearing 916. The connection bearing 916 may be allow pivotal motion between the bracket 914 and the arm portion 1006.

The bracket 914 may include a flange 918 that depends vertically downwardly as shown in FIGS. 9 and 10. The flange 918 may include an opening through which a portion of pin 1004 is disposed. The pin 1004 may further be coupled to the first roller 920 to allow the first roller 920 to rotate relative to the flange 918.

In use, the first roller 920 may rotate along the lower surface 904 of the guide track 902. The pair of second rollers 922 may rotate along the first side surface 908 and the second side surface 910. As the door 110 moves between its open and closed positions, the pair of second rollers 922 roll or rotate along the first and second side surfaces as the first roller 920 rolls or rotates along the lower surface 904.

As described above, the guide track 902 may include a substantially identical curvature as the gear rack 230 to allow the gear 228 to move about the gear rack 230 as the rollers 920, 922 move about the guide track 902.

The gear rack 230 is designed in a circuitous manner as shown in FIGS. 2 and 4. Here, the rack 230 may include a substantially S-shaped design in which a pair of arc portions meet at an inflection point 400 located approximately midway between the first and second ends. Moreover, a first arc portion of the gear rack 230 design includes a first vertex 402 and the second arc portion includes a second vertex 404. The first vertex 402 is defined between the first end 232 and the inflection point 400, and the second vertex 404 is defined between the inflection point 400 and the second end 234.

Figure 3:
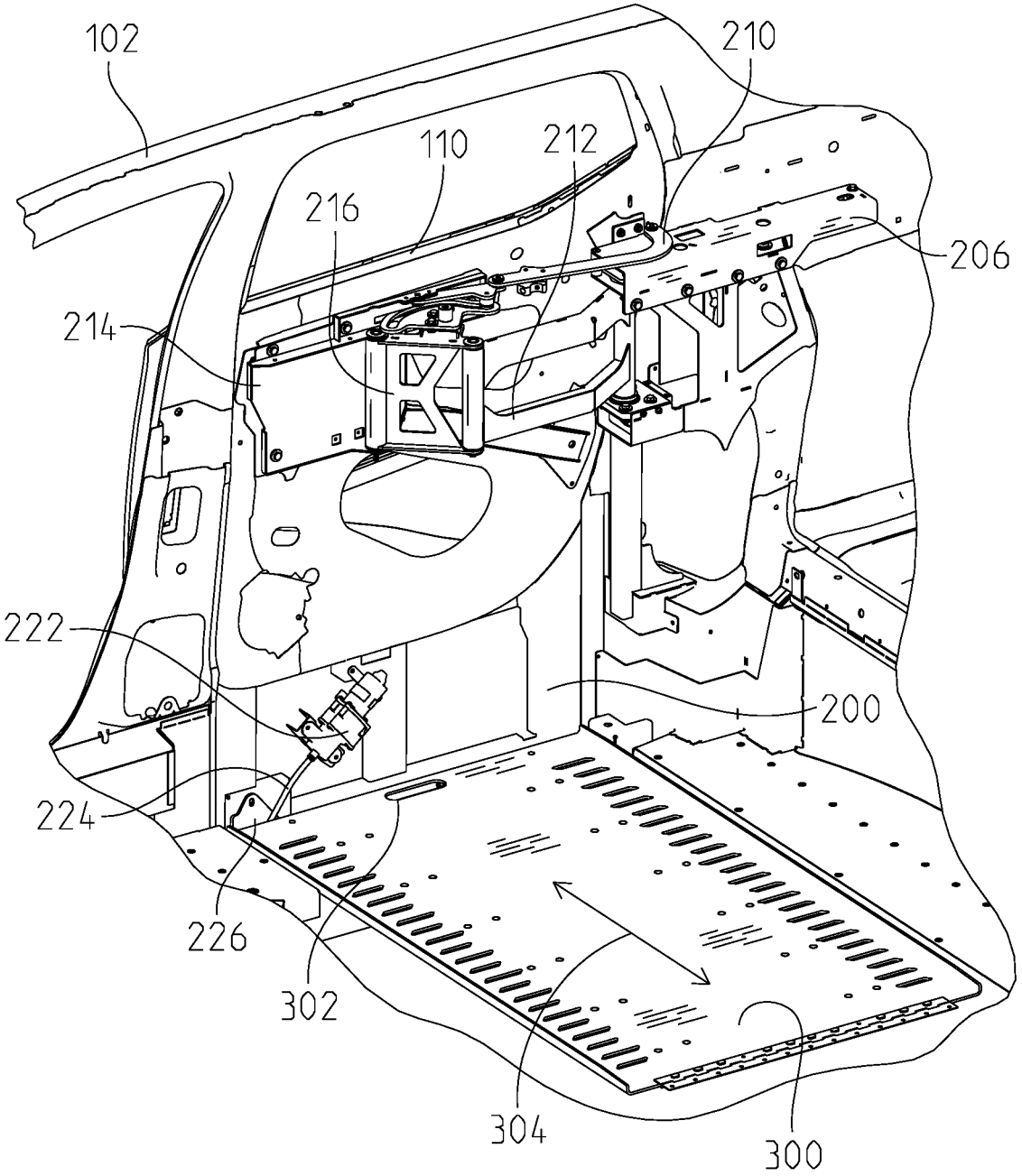
FIG. 3 illustrates another interior perspective view of the modified hinge-style door of FIG. 2 with a ramp assembly.

The door opening assembly of FIGS. 2 and 4 is further shown in FIG. 3. In FIG. 3, a ramp assembly 300 is also shown disposed within an interior of the vehicle. The ramp assembly 300 may include a handle 302 for moving the ramp assembly 300 between a stowed position (FIG. 3) and a deployed position (not shown) to accommodate the ingress and egress of a wheelchair with respect to the vehicle. Alternatively, the ramp assembly 300 may include a rod or other manual tool used for moving the ramp assembly 300.

In the closed position, the ramp assembly 300 is in its stowed position. The door 110 may block or at least partially obstruct movement of the ramp assembly 300 in either the deploying or stowing direction 304. The ramp assembly 300 may be located within a cavity or opening below a floor of the vehicle. Alternatively, the ramp assembly 300 may be removable from the vehicle 100, stowed in any location within the vehicle, and then manually coupled to the vehicle to facilitate the movement of a wheelchair into and out of the vehicle.

While FIG. 3 illustrates an embodiment in which a ramp assembly 300 is shown, it is further within the principles and teachings of the present disclosure that a ramp assembly 300 may be unnecessary in certain applications. For example, the vehicle 100 may travel to a destination where an automated ramp is provided at the location. Thus, the door opening system and ramp assembly may be exclusive to one another in one or more embodiments.

Figure 5:
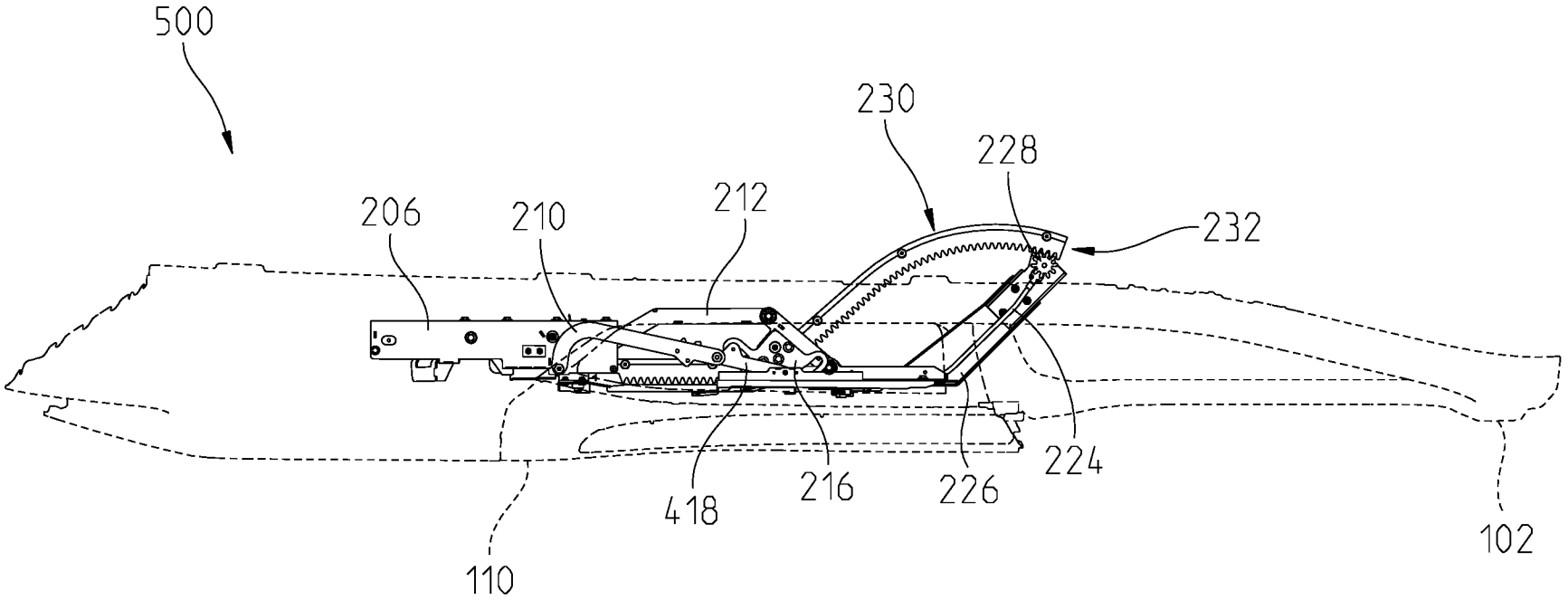
FIG. 5 illustrates a top view of the door opening assembly of FIG. 4 with the vehicle door disposed in its closed position.
Figure 6:
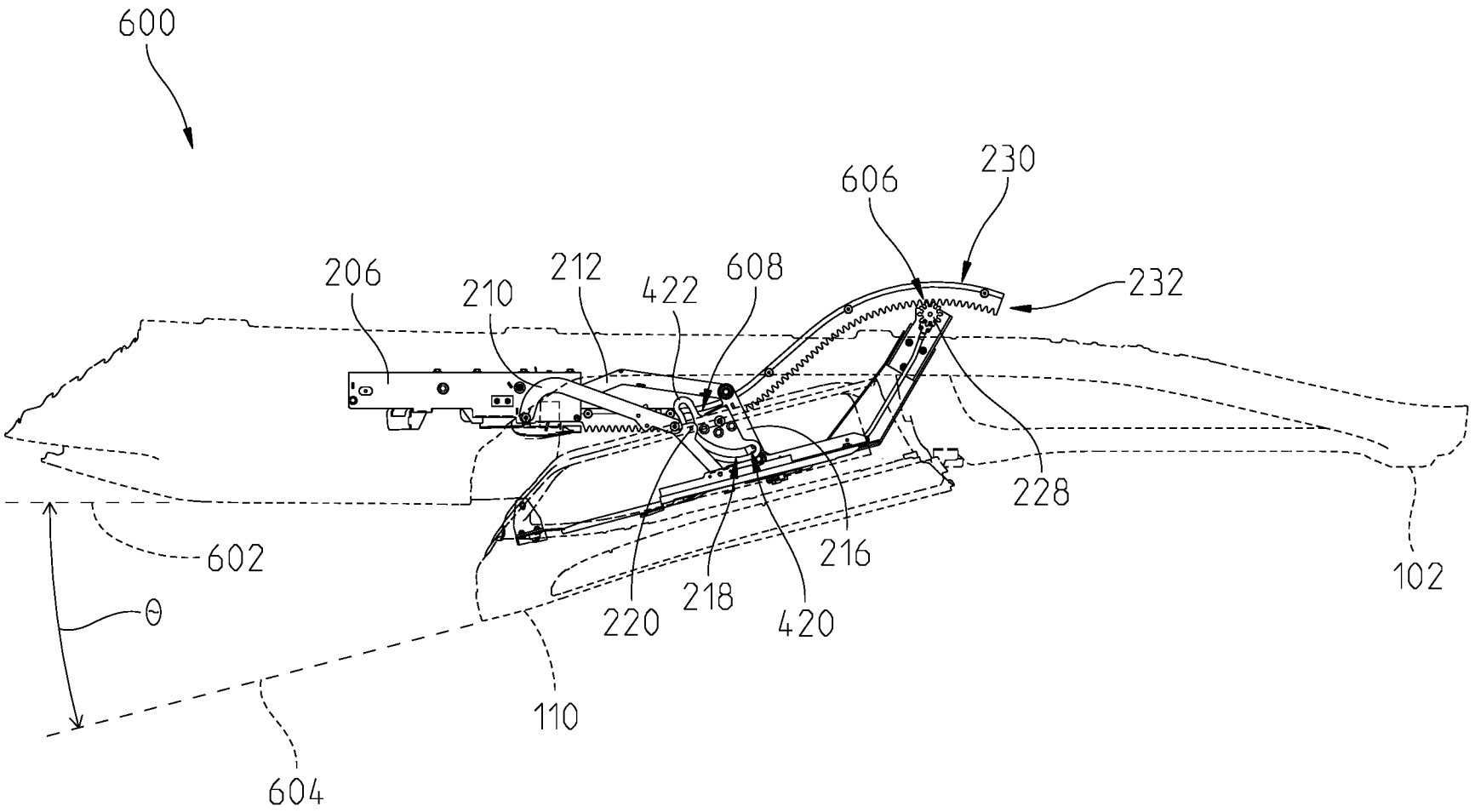
FIG. 6 illustrates a top view of the door opening assembly and the vehicle door disposed in a partially open position.
Figure 7:
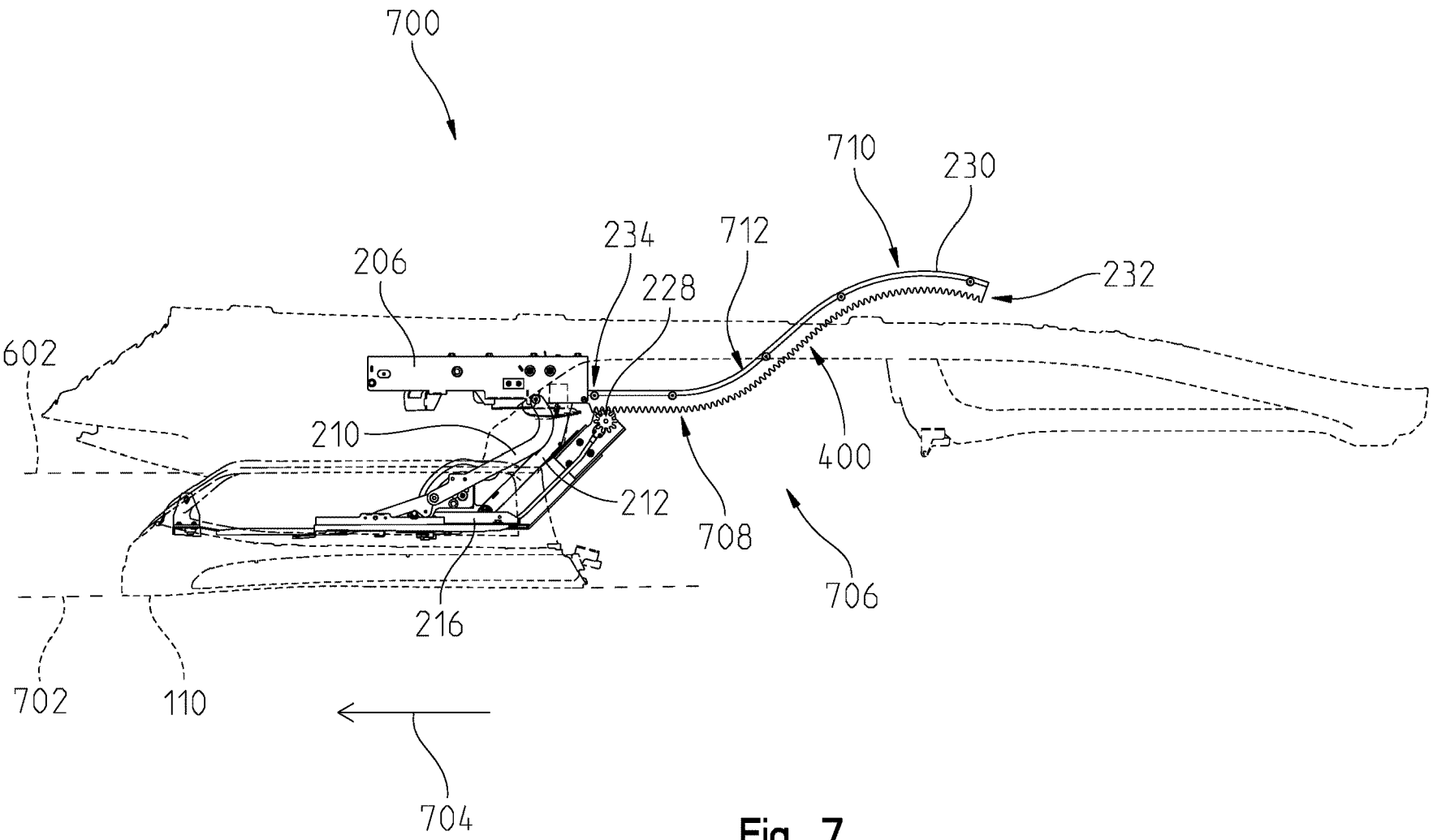
FIG. 7 illustrates a top view of the door opening assembly and the vehicle door disposed in an open position.

In FIGS. 5-7, the door opening assembly is shown in its different configurations as the door 110 moves between its closed position 500 (FIG. 5) and open position 700 (FIG. 7). Referring to FIG. 5, the rear passenger door 110 is shown in its closed position 500. In the closed position 500, the gear or pinion gear 228 is located at or near the first end 232 of the gear rack 230. This is shown in FIG. 2. In the closed position 500, the first latch 238 and second latch 240 may be selectively coupled to the door frame via one or more strikers (not shown) or other latches.

In the closed position, the pin 220 may be disposed at or near the second end 422 of the slot 218. This is best shown in FIG. 4. Moreover, in FIG. 5, the door 110 may be aligned substantially parallel to the vehicle axis 118.

Figure 8:
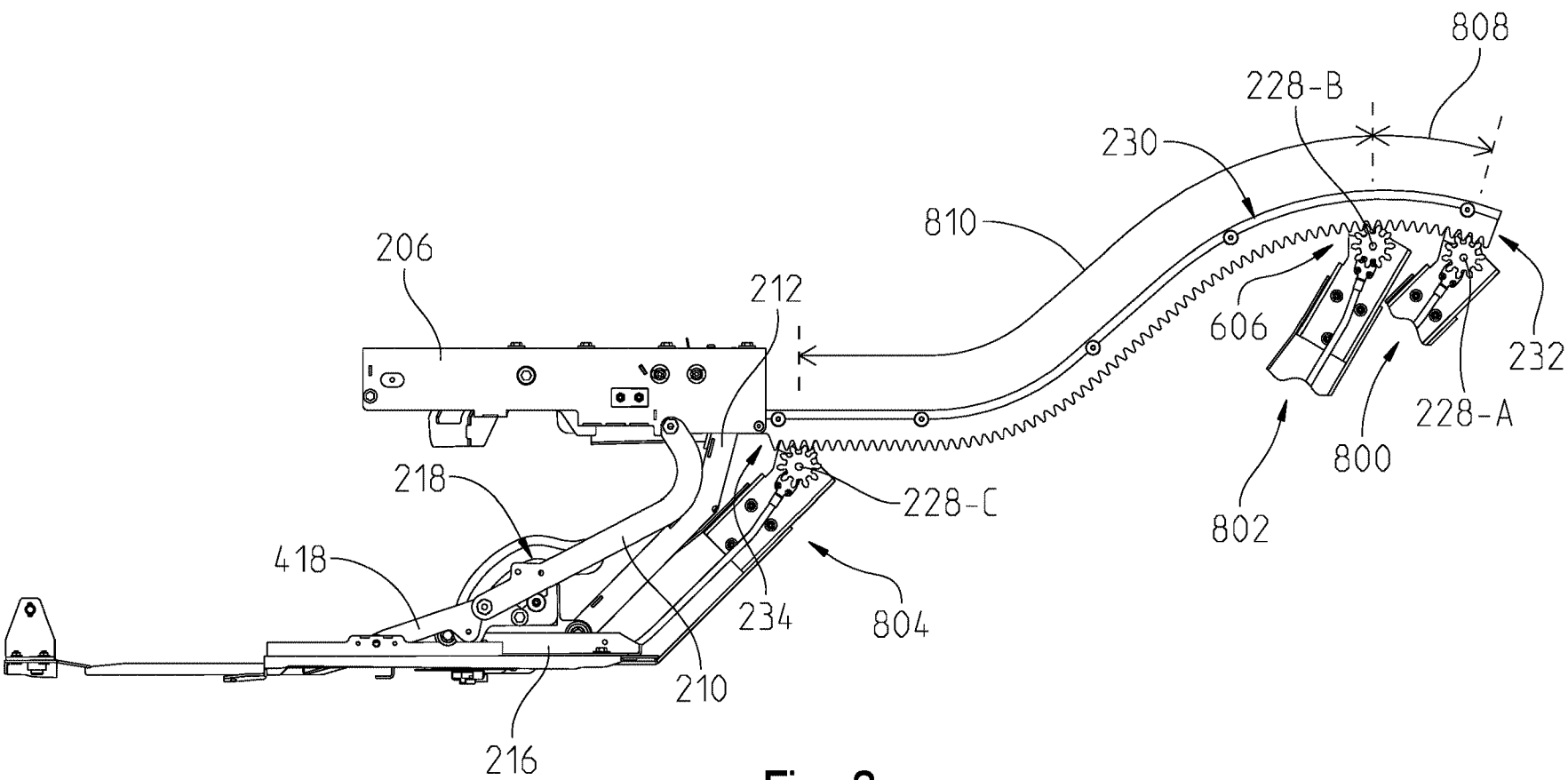
FIG. 8 illustrates the door opening assembly in the closed position, partially open position, and open position.

In FIG. 6, the door 110 is shown in a partially open position 600. During its movement from the closed position 500 to the open position 700, the gear 228 traverses along the gear rack 230 from the first end 232 to an intermediate position 606 along the gear rack 230. The intermediate position 606 is located between the first end 232 and the second end 234. In particular, the intermediate position 606 is closer to the first end 232 than the second end 234. In FIG. 8, for example, the gear 228 is shown having travelled a distance 808 from the first end 232 to the intermediate position 606. By contrast, in FIG. 8, the gear 228 travels a much greater distance 810 from the intermediate position 606 to the second end 234 before reaching the open position 700. FIG. 8 illustrates a trajectory of the gear 228 and door opening assembly from a closed configuration 800 (FIG. 5), a partially open configuration 802 (FIG. 6) and an open configuration 804 (FIG. 7).

As shown, the distance between the first end 232 of the gear rack 230 to the intermediate position 606 may be referred to as a first distance, and the distance between the intermediate position 606 and the second end 234 may be referred to as a second distance. In one example, the second distance is at least twice the first distance. In another example, the second distance is at least three times the first distance. In a further example, the second distance is at least four times the first distance. In yet a further example, the second distance is at least five times the first distance. In yet another example, the second distance may be at least 5-10 times the first distance.

In any event, in the partially open position 600, the gear 228 may be located at or near the first vertex 402 as shown in FIG. 4. While the gear 228 may not travel a great distance between the first end 232 and the intermediate position 606, the remainder of the door opening assembly is configured to reposition the door 110 relative to the door frame. For purposes of this embodiment, the door frame may form part of the vehicle body or chassis 102 and is aligned along a door frame axis 602. In at least one example, the door frame axis 602 may be substantially parallel to the vehicle axis 118. The terms "substantially" and "approximately are intended to mean within at least 10% of a certain value.

As shown in FIG. 6, the door 110 may be disposed at an angle Θ relative to the door frame axis 602. At the angle Θ, the door 110 may be aligned along In one example, the angle Θ may be between 5-45°. In another example, the angle Θ may be between 5-30°. In yet another example, the angle Θ may be between 5-25°. In a further example, the angle Θ may be between 10-20°. In yet a further example, the angle Θ may be between 12-18°. In yet another example, the angle Θ may be approximately 15°.

Thus, when opening the door 110 from its closed position 500, the first step in the door opening process is to pivot the door 110 outwardly by an angle Θ relative to the door frame (not shown). To achieve the pivoting action of the door 110, the pin 220 may move within the slot 218 from the second end 422 to an intermediate location 608 between the first end 420 and the second end 422. To achieve this movement of the pin 220 within the slot 218, the pivot arm 212 may pivot relative to the first pivot axis 408 and the pivot bracket 216 may pivot relative to the second pivot axis 410 and the third pivot axis 412.

As the door 110 moves from its closed position 500 to the partially open position 600, the gear 228 travels along the gear rack from the first end 232 to the intermediate position 606 and the pin 220 travels through the slot 218 from the second end 422 to the intermediate location 608. The distance from the first end 232 of the gear rack 230 to the second end 234 is greater than the distance from the second end 422 of the slot 218 to the first end 420.

For purposes of characterizing the travel of the gear 228 relative to the pin 220, a first ratio of travel of the gear 228 may be defined as the travel of the gear 228 from the first end 232 to the intermediate position 606 relative to the overall gear rack distance from the first end 232 to the second end 234 and a second ratio of travel of the pin 228 may be defined as the ratio of travel of the pin 220 from the second end 422 to the intermediate location 608 relative to the overall slot length from the second end 422 to the first end 420. In one example, the first ratio is substantially equivalent to the second ratio. In another example, the first ratio may be greater than the second ratio. In yet another example, the first ratio may be less than the second ratio.

As the door opening assembly further assists with moving the door 110 from its partially open position 600 to its open position 700, the door 110 may further move in an opening direction 704. As the door 110 moves in the opening direction 704, a door opening 706 may be formed in the area of the door frame vacated by the door 110. In particular, the door 110 may move along a door axis 702 as it moves to the open position 700.

In the open position, the gear 228 may move to the second end 634 of the gear rack 630 and the pin 220 moves to the first end 420 of the slot 218. The link 210 pivots about its pivot connection 414 and relative to the frame member 206. Moreover, the pivot arm 212 continues to pivot about the first pivot axis 408 relative to the frame member 206, and the pivot bracket 216 pivots about the second pivot axis 410 relative to the pivot arm 212 and the third pivot axis 412 relative to the mounting bracket 214.

In FIGS. 4 and 7, the gear rack 230 is shown being substantially S-shaped with a first arc portion 710 and a second arc portion 712. The first arc portion 710 may be substantially convex and the second arc portion 712 may be substantially concave. Further, the first arc portion 710 may be defined between the first end 232 of the gear rack 230 and the inflection point 400 (see FIG. 7), and the second arc portion 712 may be defined between the second end 234 of the gear rack 230 and the inflection point 400. As shown in FIG. 7, the first arc portion 710 is substantially arcuate-shaped, whereas the second arc portion 712 may include a substantially linear portion 708 near the second end 234 of the gear rack 230. The substantially linear portion 708 of the gear rack 230 allows the gear 228 to travel in a substantially linear manner that corresponds with the door 110 moving in the opening direction 704 along the door axis 702.

The length of the gear rack 230, and in particular the length of the substantially linear portion 708, may allow the door 110 to travel an additional rearward distance thereby allowing the door opening 706 to be wide enough to accommodate the ingress and egress of a wheelchair. Moreover, the wider door opening 706 may allow for the ramp assembly 300 to move between its stowed and deployed positions.

In one example, the door 110 may move between 1-12 inches further rearward due to the shape and design of the gear rack 230. In another example, the door 110 may move between 1-8 inches further rearward. In yet another example, the door 110 may move between 1-6 inches further rearward. In a further example, the door 110 may move approximately 4 inches further rearward as a result of the door opening assembly and the path of travel of the gear 228 along the gear rack 230.

Figure 11:
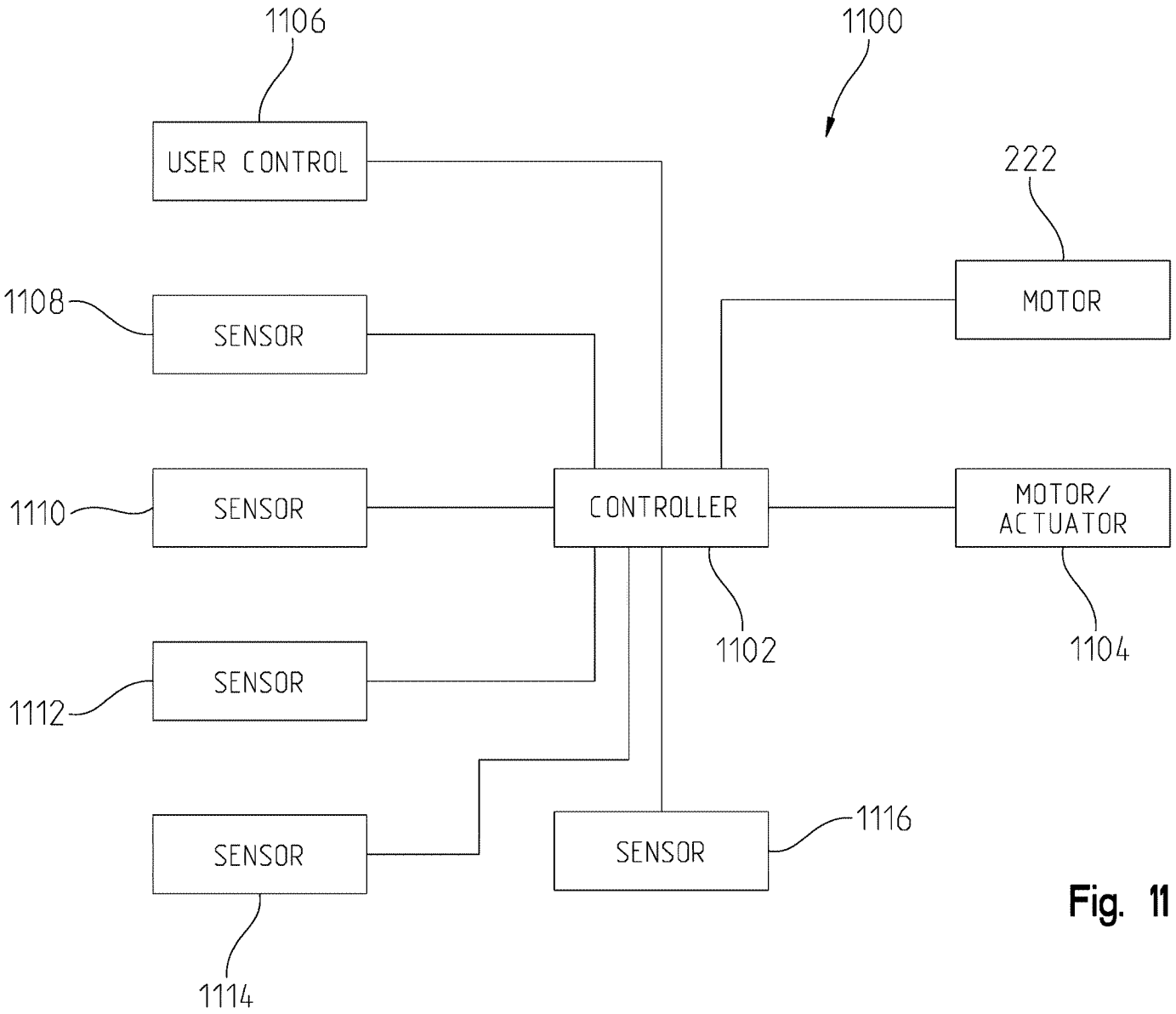
FIG. 11 illustrates a schematic of a control system for controlling movement of a door opening assembly.

Referring to FIG. 11, the door opening assembly may be controlled via a control system 1100 including a controller 1102. The controller 1102 may operably control other functions of the vehicle besides the movement of the door 110 between its open and closed positions. In one example, the controller 1102 may operably control the motor 222 which drives the gear 228 along the gear rack 230. The controller 1102 may operably control a second motor or actuator 1104 to further drive the pivot arm 212 and/or pivot bracket 216. In this instance, the controller 1102 may operably control the second motor or actuator.

The controller 1102 may be in communication with a user control 1106. The user control 1106 may be located on the door 110, door frame or other location in the vehicle 100. Alternatively, the user control 1106 may be located on a key fob. The user control 1106 may be actuated or triggered by a user to automatically open or close the door 110. Upon triggering the user control 1106, the controller 1102 may operably drive the motor 222 and any other motor or actuator which operably drives the door opening assembly.

In FIG. 11, the control system 1100 may also include one or more position sensors capable of detecting a position of the gear 228 along the gear rack 230, the rollers relative to the guide track 902, and/or the pin 220 within the slot 218. For instance, a first position sensor 1108 may be located at or near the first end 232 and a second position sensor 1110 may be located at or near the second end 234 of the gear rack 230, and each of the first and second sensors may communicate to the controller 1002 the location of the gear 228 relative to each end. The same may be true for detecting the position of the first roller 920 and/or the pair of second rollers 922 relative to each end of the guide track 902.

There may also be a third sensor 1112 located at or near the first end 420 and a fourth sensor 1114 located at or near the second end 422 of the slot 218. The third and fourth position sensors may communicate to the controller 1102 the location of the pin 220 relative to both ends of the slot 218. Thus, each of the aforementioned sensors may be in communication with the controller 1102 to communicate the position of the gear 228 or pin 220. As such, the controller may receive communications about where the door 110 is located relative to the door frame.

Similarly, a fifth sensor 1116 may be provided for detecting a position of the ramp assembly 300 relative to the vehicle. In one example, if the ramp assembly 300 is deployed, the controller 1102 may prevent the door 110 from being closed until the ramp assembly 300 returns to its stowed position (or is decoupled from the vehicle floor). The sensor 1116 may alert the controller 1102 once the ramp 300 returns to its stowed position. Likewise, the sensor 1116 may communicate to the controller 1102 when the ramp 300 is in its fully deployed position.

While the control system 1100 has been described in detail, it is to be understood that the control system 1100 may be capable of performing additional functions. For example, the control system 1100 may be capable of performing an algorithm, control function, software and the like for controlling the opening and closing of the door. The control system 1100 may control the door 110 electrically, mechanically, hydraulically, pneumatically, or a combination thereof. For example, the motor 222 may be an electro-hydraulic motor. Other arrangements are possible for controlling the door movement.

In a further embodiment of the present disclosure, a method is further contemplated of converting a convention, hinge-style door from a motorized vehicle into a sliding door according to the principles and teachings above. In particular, the method may include removing the conventional door and modifying it such that the modified door includes either or both latches 238, 240. The door may further be modified by coupling the base 406 of the frame member 206 to the vehicle (e.g., vehicle floor) and the mounting bracket 214 to an inner surface of the door. The link 210 may be coupled to the frame member 206 via the pivot connection 414. The pivot arm 212 may be coupled to the frame member 206. The pivot bracket 216 may be pivotally coupled to the mounting bracket 214 about the third pivot axis 412, and the link arm 418 may be coupled to the to the pivot bracket 216 and the link 210. The pin 220 on the link arm 418 may be disposed within the slot 218 in the pivot bracket.

The method may also include coupling the drive track 902 to the vehicle, such as the vehicle floor. The gear rack 230 may also be coupled to the vehicle. The bracket 226 may be mounted to the inner surface of the door 110, and the arm 912 may be coupled to the bracket 226. The plurality of rollers may be coupled to the bracket 914 as described above. Each of the plurality of rollers may be positioned within the drive track 902 to engage the surfaces of the drive track 902 to allow for rotation therealong. The motor 222 may be coupled to the interior of the door or another location on the vehicle. The cable 224 may be coupled from an output of the motor 222 to the gear 228. The gear 228 may be positioned at the first end 232 of the gear rack 230 when the door is in its closed position.

While exemplary embodiments incorporating the principles of the present disclosure have been disclosed hereinabove, the present disclosure is not limited to the disclosed embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A door opening assembly for moving a vehicle door of a motorized vehicle between an open position and a closed position, comprising:

a frame member configured to be coupled to a body of the vehicle;

a link operably coupled to the frame member;

a link arm comprising a pin, the link arm pivotally coupled about the link;

a pivot arm pivotally coupled to the frame member;

a pivot bracket pivotally coupled to the door and the pivot arm, the pivot bracket further defining a slot having a first end and a second end;

a gear rack comprising a plurality of teeth, the gear rack including a first end and a second end;

a gear operably coupled to the gear rack, the gear operably driven between the first and second ends of the gear rack as the door moves between its open and closed positions;

a guide track configured to be coupled to the body of the vehicle; and a plurality of rollers rotatably driven along the guide track as the door moves between its open and closed positions;

wherein, as the door moves between its open and closed positions, the pin moves within the slot between the first end and the second end of the slot.

2. The assembly of claim 1, wherein:

the pivot arm is pivotally coupled to the frame member about a first pivot axis;

the pivot bracket is pivotally coupled to the pivot arm about a second pivot axis, wherein the first pivot axis is parallel to but spaced from the second pivot axis.

3. The assembly of claim 2, wherein the pivot bracket is pivotally coupled to a mounting bracket about a third pivot axis, the third pivot axis being parallel but offset from the first and second pivot axes.

4. The assembly of claim 1, wherein the gear rack comprises a substantially S-shaped curvature.

5. The assembly of claim 1, wherein the gear rack comprises a length defined between its first end and its second end, the gear rack comprising a first arc portion, a second arc portion, and a substantially linear portion.

6. The assembly of claim 5, wherein the gear rack comprises a first vertex, a second vertex, and an inflection point located therebetween;

wherein:

the first arc portion is defined between the first end of the gear rack and the inflection point;

the second arc portion is defined between the inflection point and the substantially linear portion;

the substantially linear portion defined between the second end of the gear rack and the second arc portion.

7. The assembly of claim 1, wherein the guide track comprises a shape substantially the same as the gear rack.

8. The assembly of claim 1, wherein the plurality of rollers comprises a first roller and a pair of second rollers, the first roller having a larger diameter than each of the pair of second rollers.

9. The assembly of claim 8, wherein:

the first roller is rotatable about a first rotation axis;

a first of the pair of second rollers is rotatable about a second rotation axis;

a second of the pair of second rollers is rotatable about a third rotation axis;

the first rotation axis being oriented substantially perpendicular to the second and third rotation axes.

10. The assembly of claim 1, wherein:

in the closed position, the pin is located at the first end of the slot and the gear is located at the first end of the gear rack;

in the open position, the pin is located at the second end of the slot and the gear is located at the second end of the gear rack.

11. The assembly of claim 10, wherein during movement of the door from its closed position to its open position, the gear moves from the first end of the gear rack to an intermediate position;

wherein, in the closed position, the door is positioned along a door frame axis;

wherein, in the intermediate position, the door is positioned at an angle relative to the door frame axis;

wherein, in the open position, the door is positioned substantially parallel to but offset from the door frame axis.

12. The assembly of claim 11, wherein a first distance defined between the first end and the intermediate position of the gear rack is shorter than a second distance defined between the intermediate position and the second end of the gear rack.

13. A door opening assembly for moving a vehicle door of a motorized vehicle between an open position and a closed position, comprising:

a first assembly comprising:

a frame member configured to be coupled to a body of the vehicle;

a link operably coupled to the frame member;

a link arm comprising a pin, the link arm pivotally coupled about the link;

a pivot arm pivotally coupled to the frame member; and a pivot bracket pivotally coupled to the door and the pivot arm, the pivot bracket further defining a slot having a first end and a second end;

wherein, as the door moves between its open and closed positions, the pin moves within the slot between the first end and the second end;

a second assembly comprising:

a gear rack comprising a plurality of teeth, the gear rack including a first end and a second end;

a gear operably coupled to the gear rack, the gear operably driven by a motor between the first and second ends of the gear rack as the door moves between its open and closed positions;

a guide track configured to be coupled to the body of the vehicle; and a plurality of rollers rotatably driven along the guide track as the door moves between its open and closed positions; and a control system for operably controlling the motor, the control system including a controller;

wherein, the controller is configured to receive a communication from a user control to operably drive the motor to move the door from its open and closed positions.

14. The assembly of claim 13, further comprising a second motor for operably controlling pivotal movement of the pivot arm or pivot bracket, the second motor operably driven by the controller.

15. The assembly of claim 13, further comprising a sensor in communication with the controller, the sensor configured to detect a location of the pin relative to the first and second ends of the slot.

16. The assembly of claim 13, further comprising a sensor in communication with the controller, the sensor configured to detect a location of the gear relative to the first and second ends of the gear rack.

17. The assembly of claim 13, further comprising a sensor in communication with the controller, the sensor configured to detect a location of at least one of the plurality of rollers relative to the guide track.

18. The assembly of claim 13, further comprising:

a ramp assembly operably coupled to the body of the vehicle;

a sensor in communication with the controller, the sensor configured to detect a position of the ramp assembly relative to the body of the vehicle.

19. The assembly of claim 18, wherein the controller operably disables the motor when the sensor communicates to the controller that the ramp assembly is in a deployed position.

20. A method of controlling movement of a vehicle door from a closed position to an open position, the vehicle door being operably coupled to a body of a motorized vehicle, the method comprising:

providing the vehicle door with a door opening assembly comprising a frame member coupled to the body of the vehicle, a link, a link arm including a pin, a pivot arm, a pivot bracket having a slot, a gear rack, a gear, a motor, a guide track, a plurality of rollers, and a controller, wherein the link arm is pivotally coupled about the link;

in the closed position, positioning the pin at a first end of the slot, the gear at a first end of the gear rack, and the plurality of rollers at a first end of the guide track;

releasing a latch of the door from the body of the motorized vehicle;

driving the motor by the controller to pivot the door from the closed position to a partially open position, where in the partially open position the gear is at an intermediate position and the pin is located between the first end and a second end of the slot; and driving the motor by the controller from the partially open position to the open position, where in the open position the gear is at a second end of the gear rack, the pin is at the second end of the slot, and the plurality of rollers are located at a second end of the guide track.

* * * * *